US005191865A

United States Patent [19]

Minamitani et al.

[11] Patent Number: 5,191,865

[45] Date of Patent: Mar. 9, 1993

[54] ENGINE IDLE CONTROL SYSTEM FOR VEHICLE

[75] Inventors: Kunitomo Minamitani; Hiromo Yoshioka; Shigeaki Kakizaki, all of Hiroshima, Japan

[73] Assignee: Mazda Motor Corporation, Hiroshima, Japan

[21] Appl. No.: 763,599

[22] Filed: Sep. 23, 1991

[30] Foreign Application Priority Data

Sep. 27, 1990 [JP] Japan ..... 2-255355

[51] Int. Cl.[5] ..... F02D 41/16

[52] U.S. Cl. ..... 123/339

[58] Field of Search ..... 123/339, 585

[56] References Cited

U.S. PATENT DOCUMENTS 4,492,195 1/1985 Takahashi et al. ..... 123/339

4,966,111 10/1990 Fujimoto et al. ..... 123/339 X

FOREIGN PATENT DOCUMENTS 54-72319 6/1979 Japan .

*Primary Examiner*—Tony M. Argenbright

*Attorney, Agent, or Firm*—Sixbey, Friedman, Leedom & Ferguson

[57] ABSTRACT

An engine idle control system for a vehicle causes the engine speed to converge on a target idling speed by feedback control when the engine idles. Whether the engine is revolving by itself or is being driven by the vehicle is detected, and the engine speed is controlled by a proportional feedback control on the basis of the difference between the actual engine speed and the target idling speed when the engine is being driven by the vehicle, and is controlled by a control at least a part of which is an integral feedback control when the engine is revolving by itself.

4 Claims, 5 Drawing Sheets

ENGINE IDLE CONTROL SYSTEM FOR VEHICLE

BACKGROUND OF THE INVENTION

1. Field of the Invention

This invention relates to an engine idle control system for a vehicle.

2. Description of the Prior Art

There has been known an engine idle control system for a vehicle which has a bypass passage provided in an intake passage of the engine to bypass a throttle valve and controls the amount of air flowing through the bypass passage by control of a duty solenoid valve provided in the bypass passage so that the engine speed converges on a predetermined value when the throttle valve is in an idle position. In such an idle control system, the duty solenoid valve is generally feedback-controlled on the basis of the difference between a target engine speed and the actual engine speed during idling so that the actual engine speed converges on the target engine speed. The feedback control is mainly performed on the basis of an integral control and partly performed on the basis of a combination of an integral control and a proportional control.

However when the engine speed is feedback-controlled by the integral control, the engine speed can be continued to be lowered after the actual engine speed falls below the target engine speed in the case where the engine speed lowers and the engine comes to be to idle during deceleration of the vehicle, which can result in excessively low idling speed or stall of the engine.

Though it is proposed to interrupt the feedback control of the idling speed in Japanese Unexamined Patent Publication No. 54(1979)-72319, it is preferred that the feedback control be effected from deceleration before the engine goes into idle in order to quickly stabilize the engine speed.

SUMMARY OF THE INVENTION

In view of the foregoing observations and description, the primary object of the present invention is to provide an engine idle control system for a vehicle which can control the idling speed of the engine without fear that the engine speed falls excessively low or the engine stalls even when the engine decelerates and goes into idle.

In the idle control system in accordance with the present invention, it is detected whether the engine is revolving by itself or is being driven by the vehicle and the engine speed is controlled by a proportional feedback control on the basis of the difference between the actual engine speed and the target idling speed when the engine is being driven by the vehicle, and is controlled by a control at least a part of which is an integral feedback control when the engine is revolving by itself.

Whether the engine is revolving by itself or is being driven by the vehicle can be determined, for instance, on the basis of the difference between the engine speed and the turbine speed.

Since, in the idle control system of the present invention, the engine speed is controlled by a proportional feedback control on the basis of the difference between the actual engine speed and the target engine speed when the engine is being driven by the vehicle, which is the case when the engine decelerates and goes into idle, the engine speed can be quickly converged on the target engine speed without fear that the engine speed falls excessively low or the engine stalls.

DESCRIPTION OF THE PREFERRED EMBODIMENT

Figure 1:
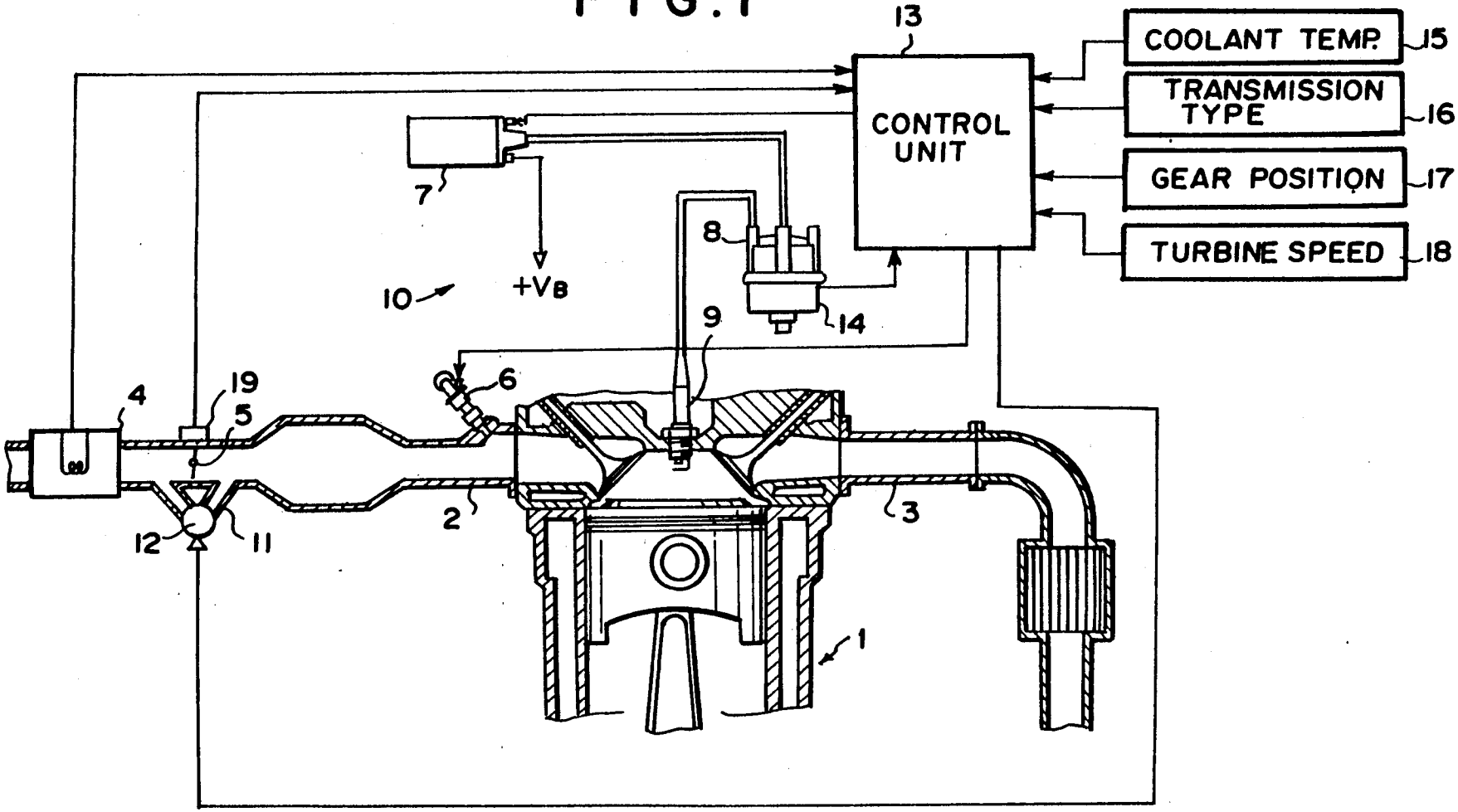
FIG. 1 is a schematic view showing an engine provided with an idle control system in accordance with an embodiment of the present invention, FIG. *2a* and *2b* are a flow chart showing the idling speed control by the control unit.

In FIG. 1, an engine 1 has an intake passage 2 and an exhaust passage 3. A hot wire airflow meter 4, a throttle valve 5 and a fuel injector 6 are provided in the intake passage 2. The engine 1 is further provided with an ignition system 10 comprising an ignition coil 7, a distributor 8 and a spark plug 9.

The intake passage 2 is provided with a bypass passage 11 which bypasses the throttle valve 5. The bypass passage 11 is provided with an electromagnetic solenoid valve 12 which controls the flow rate of air flowing through the bypass valve 11 and controls the idling speed of the engine 1. The solenoid valve 12 is controlled by a control unit 13 which may comprise a microcomputer.

The control unit 13 receives output signals from the airflow meter 4, an engine speed sensor 14, an engine coolant temperature sensor 15, a transmission type determining means 16 which determines the type of the transmission the vehicle is provided with (whether the vehicle is provided with an automatic transmission AT or a manual transmission MT), a gear position sensor 17, a turbine speed sensor 18 which detects the rotational speed of the turbine of the automatic transmission, and an idle switch 19 which outputs an on-signal when the throttle valve 5 is full closed, and controls the amount of fuel to be injected from the injector 6, the ignition timing and the idling speed of the engine. The control of the amount of fuel to be injected from the injector 6 and the ignition timing is not directly related with this invention, and accordingly will not be described here.

The control of the idling speed by the control unit 13 will be described with reference to FIGS. 2 to 7, hereinbelow.

Figure 2A:
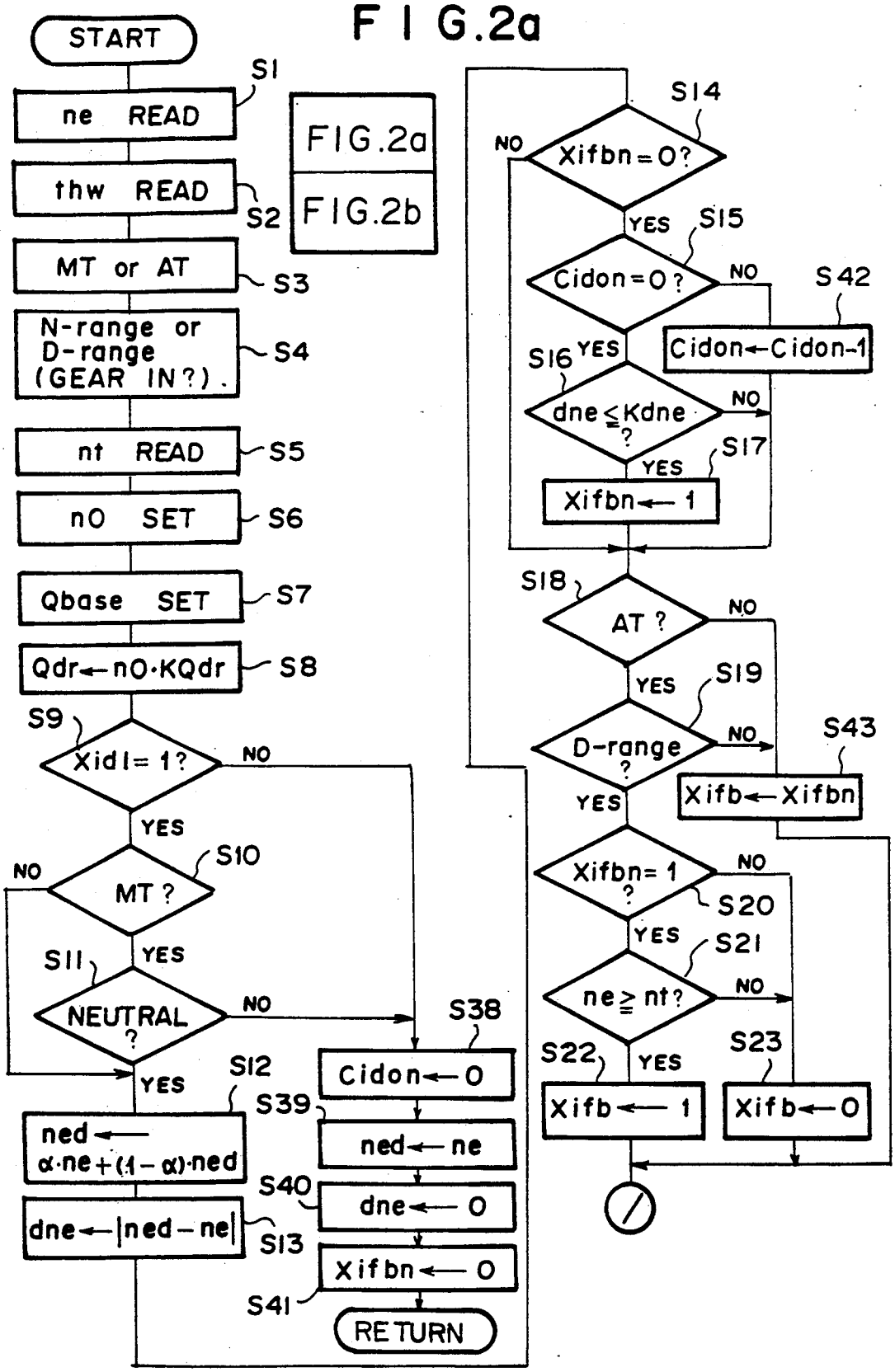
Figure 2B:
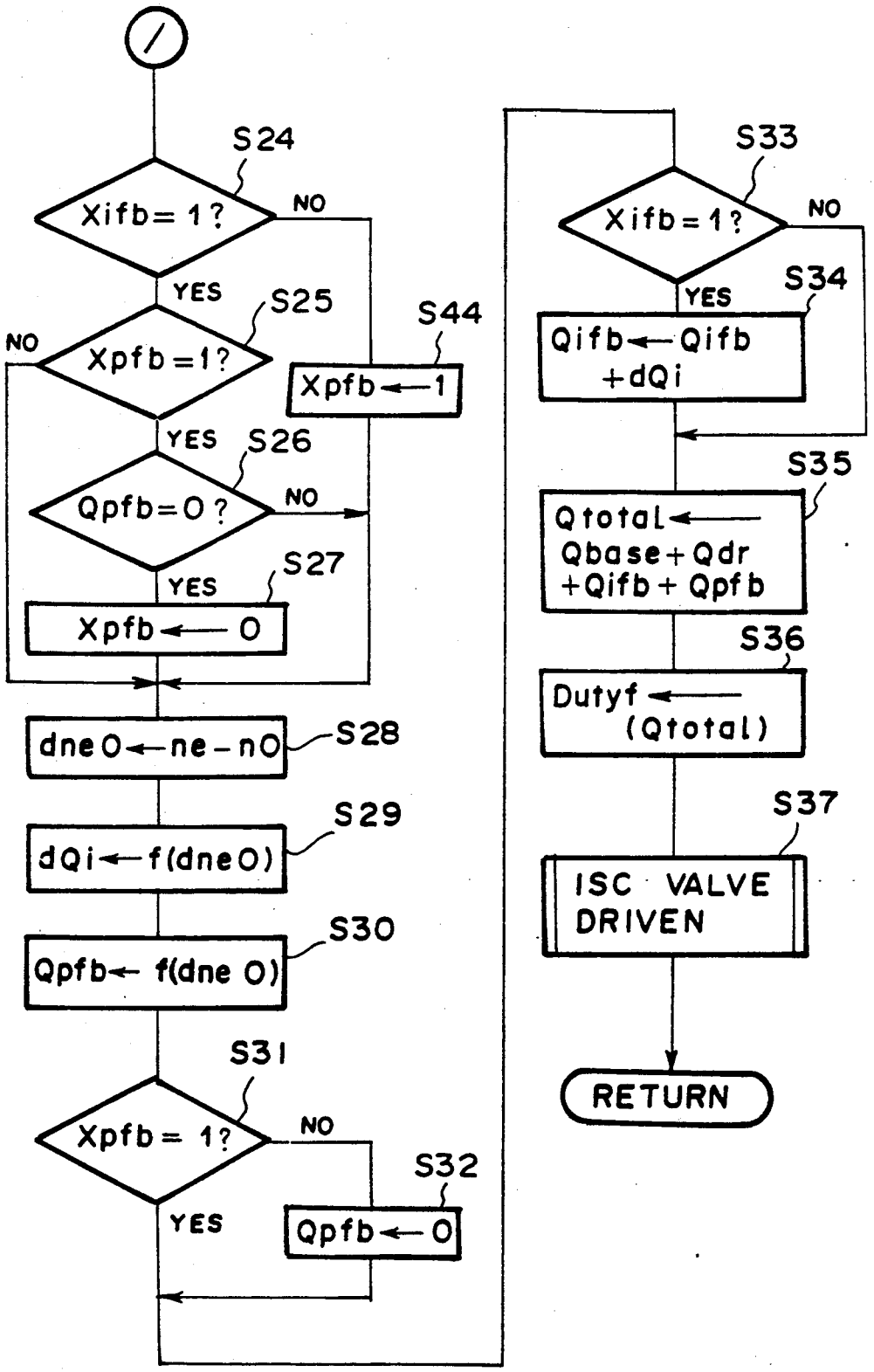

In FIG. 2, the control unit 13 reads the engine speed ne, the engine coolant temperature thw, and whether the vehicle is provided with an automatic transmission AT or a manual transmission MT. In the case of an automatic transmission vehicle, the control unit 13 further reads whether the transmission is in N-range or D-range, and reads the turbine speed nt. In the case of a manual transmission vehicle, the control unit 13 further reads whether the gear is in. (steps S1 to S5)

Figure 3:
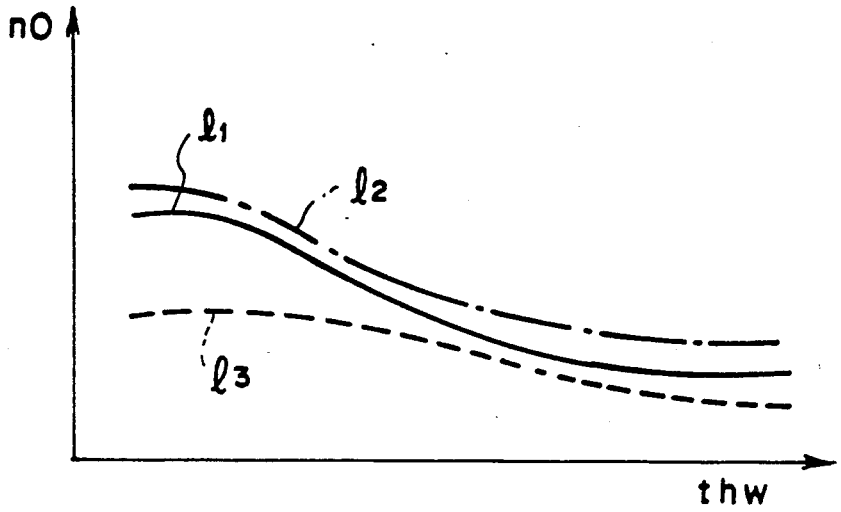
FIG. 3 is a map showing target engine speed-engine coolant temperature characteristics.
Figure 4:
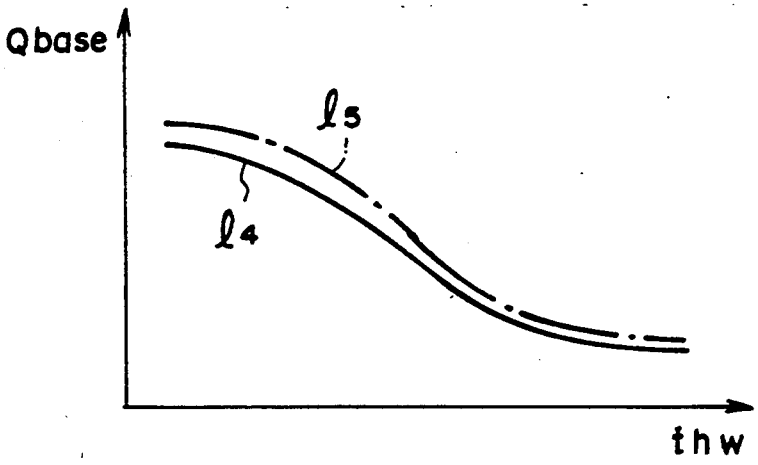
FIG. 4 is a map showing base flow rate-engine coolant temperature characteristics.

In step S6, the control unit 13 sets a target engine speed nO according to the target engine speed-engine coolant temperature (nO-thw) characteristic map shown in FIG. 3. The nO-thw characteristic map has been stored in the control unit 13 and has an MT nO-thw characteristic curve 11 for setting the target engine speed nO in the manual transmission vehicle, an N-range nO-thw characteristic curve 12 for setting the target engine speed nO in the automatic transmission vehicle when the transmission is N-range, and a D-range nO-thw characteristic curve 13 for setting the target engine speed nO in the automatic transmission vehicle when the transmission is D-range. Then in step S7, the control unit 13 sets a basic flow rate Qbase of air flowing through the bypass passage 11 according to the basic flow rate-engine coolant temperature (Qbase-thw) characteristic map shown in FIG. 4. The Qbase-thw characteristic map has been stored in the control unit 13 and has an MT Qbase-thw characteristic curve 14 for setting the basic flow rate Qbase in the manual transmission vehicle, and an AT Qbase-thw characteristic curve 15 for setting the basic flow rate Qbase in the automatic transmission vehicle. Then in step S8, the control unit 13 sets a D-range correction amount Qdr for compensating for load on the torque convertor of the automatic transmission. The D-range correction amount Qdr is obtained by multiplying the target engine speed nO by a constant KQdr which is set to 0 when the vehicle is provided with the manual transmission or when the automatic transmission is in N-range.

In step S9, the control unit 13 determines whether idle flag Xidl is 1. The idle flag Xidl is set to 1 when the throttle valve 5 is full closed. When the answer to the question in step S9 is yes, the control unit 13 further determines in step S10 whether the vehicle is provided with a manual transmission. When the answer to the question in step S10 is yes, the control unit 13 further determines in step S11 whether the transmission is in neutral. When the answer to the question in step Sll is yes or when the answer to the question in step S10 is no, the control unit 13 proceeds to step S12. In step S12, the control unit 13 calculates a "dull engine speed" ned according to the following formula.

$$ned = \alpha \cdot ne + (1-\alpha) \cdot ned$$

wherein $\alpha$ being a constant larger than 0 and smaller than 1. The dull engine speed ned is similar to a weighted average of preceding engine speeds.

Thereafter the control unit 13 calculates in step S13 the absolute difference dne between the dull engine speed ned and the actual engine speed ne. The control unit 13 determines whether feedback flag Xifbn is 0, the feedback flag Xifbn being set to 1 when feedback control is going. When the answer to the question in step S14 is yes, the control unit 13 determines in step S15 whether a counter Cidon has been reset to 0. The counter Cidon is set to a predetermined time when the idle flag Xidl is set to 1. For a while after calculation of the dull engine speed is commenced, the difference between the dull engine speed dne and the actual engine speed ne is not so large and if the difference is used, the feedback control cannot be properly effected. The counter Cidon is set for the purpose of waiting until the difference sufficiently enlarges.

When the answer to the question in step S15 is yes, the control unit 13 determines in step S16 whether the difference dne is smaller than a preset value Kdne. When the operating condition of the engine approaches idle after deceleration, the difference dne becomes smaller than the preset value Kdne. When the answer to the question in step S16 is yes, the control unit 13 proceeds to step S18 after setting the feedback determination flag Xifbn to 1 in step S17. Otherwise the control unit 13 directly proceeds to step S18. In step S18, the control unit 13 determines whether the vehicle is provided with an automatic transmission. When the answer to the question in step S18 is yes, the control unit 13 determines step S19 whether the transmission in D-range. When the answer to the question in step S19 is yes, the control unit 13 determines in step S20 whether the feedback determination flag Xibfn is 1, and when the answer to the question in step S20 is yes, the control unit 13 determines in step S21 whether the actual engine speed ne is higher than the turbine speed nt, that is, whether the engine 1 is revolving by itself. When the answer to the question in step S21 is yes, that is, when the engine 1 has been idling, the control unit 13 sets an integral feedback control executing flag Xifb to 1. On the other hand, when the answer to the question in step S21 is no, that is, when the engine 1 is still decelerating, the control unit 13 sets the integral feedback control executing flag Xifb to 0.

After steps S22 and S23, the control unit 13 determines in step S24 whether the integral feedback control executing flag Xifb is 1. When the answer to the question in step S24 is yes, the control unit 13 determines in step S25 whether a proportional feedback control executing flag Xpfb is 1. When the proportional feedback control is abruptly switched to the integral feedback control, the amount of intake air largely fluctuates and the engine speed fluctuates by a large amount. Accordingly, in step S25, the control unit 13 determines whether the proportional feedback control executing flag Xpfb is 1 in order to know whether the proportional feedback control has been executed. When the answer to the question in step S25 is yes, the control unit 13 determines in step S26 whether a proportional feedback amount of intake air Qpfb is 0, and when the answer to the question in step S26 is yes, the control unit 13 resets the proportional feedback control executing flag Xpfb to 0 in step S27 since when the proportional feedback amount of intake air Qpfb is 0, large fluctuation of the engine speed cannot occur even if the proportional feedback control is switched to the integral feedback control.

Figure 5:
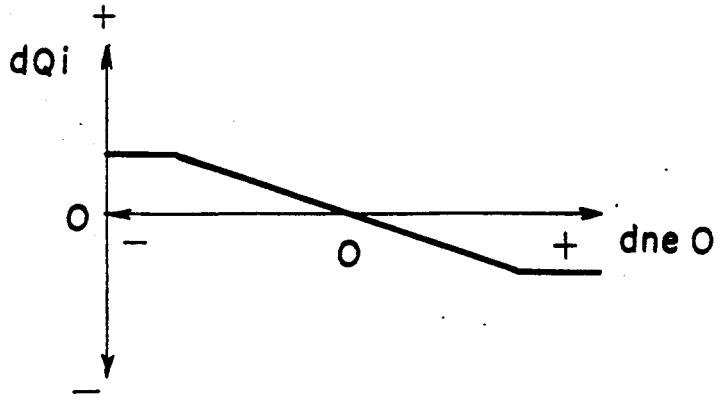
FIG. 5 is a map for determining the integral feedback correction value.
Figure 6:
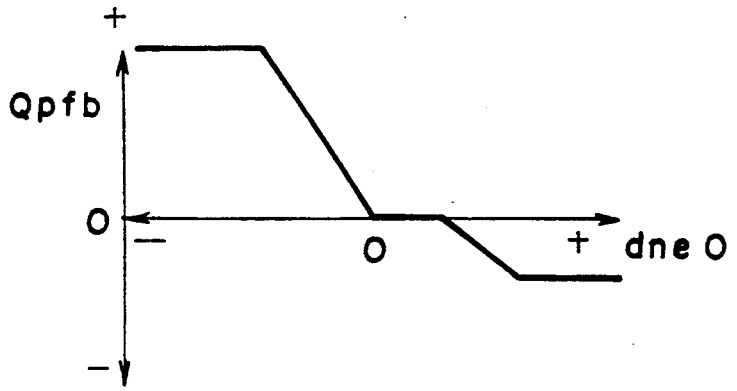
FIG. 6 is a map for determining the proportional feedback correction amount.
Figure 7:
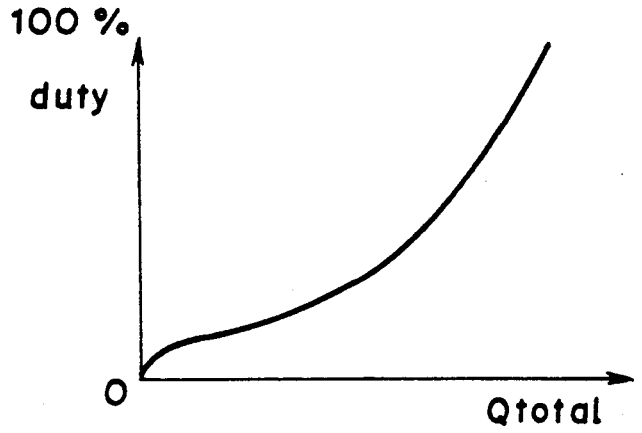
FIG. 7 is a map for determining the duty ratio for controlling the solenoid valve.

Thereafter, the control unit 13 calculates in step S28 the difference dneO between the actual engine speed ne and the target engine speed nO, and calculates in step S29 an integral feedback correction value dQi according to a map shown in FIG. 5 on the basis of the difference dneO (stored in the control unit 13). Further the control unit 13 calculates in step S30 the proportional feedback correction amount Qpfb according to a map shown in FIG. 6 on the basis of the difference dneO (stored in the control unit 13). Then the control unit 13 determines again in step S31 whether the proportional feedback control executing flag Xpfb is 1, and when the answer to the question in step S31 is no, the control unit 13 proceeds to step S33 after setting the proportional feedback correction amount Qpfb to 0 in step S32. When the answer to the question in step S31 is yes, the control unit 13 directly proceeds to step S33. In step S33, the control unit 13 determines whether the integral feedback control executing flag Xifb is 1. When the answer to the question in step S33 is yes, the control unit 13 adds the integral feedback correction value dQi to the preceding value of an integral feedback correction amount Qifb, thereby obtaining a present value of the integral feedback correction amount Qifb (step S34), and thereafter proceeds to step S35. When the answer to the question in step S33 is no, the control unit 13 directly proceeds to step S35.

In step S35, the control unit 13 adds up the basic flow rate Qbase set in step S7, the D-range correction amount Qdr set in step S8, the integral feedback correction amount Qifb and the proportional feedback correction amount Qpfb and thereby obtains a total controlled variable Qtotal. The control unit 13 obtains a control duty ratio of the solenoid valve 12 according to a map shown in FIG. 7 (stored in the control unit 13) and drives the solenoid valve 12 on the basis of the duty ratio. (steps S36 and S37) Thereafter, the control unit 13 returns to step S1.

When the answer to the question in step S9 is no, that is, when the throttle valve 5 has not been full closed, or when the answer to the question in step Sll is no, that is, when the transmission gear is in (in the case of a manual transmission vehicle), the control unit 13 resets the counter Cidon to 0, sets the dull engine speed ned to the actual engine speed ne, sets the difference dne to 0 and resets the feedback determination flag Xifbn to 0. (steps S38 to S41) Thereafter the control unit 13 returns to step S1. When the answer to the question in step S14 is no, the control unit 13 directly proceeds to step S18. When the answer to the question in step S15 is no, that is, when the counter Cidon is not 0, the control unit 13 proceeds to step S18 after decrementing the counter Cidon by 1 in step S42. When the answer to the question in step S18 or S19 is no, that is, when the vehicle is provided with a manual transmission MT, or when the vehicle is provided with an automatic transmission and the transmission is in N-range, the control unit 13 equalizes the integral feedback control execution flag Xifb to the feedback determination flag Xifbn in step S43 and then proceeds to step S24. When the answer to the question in step S24 is no, the control unit 13 sets the proportional feedback control executing flag Xpfb to 1 in step S44 and then proceeds to step S28. Further when the answer to the question in step S25 or S26 is no, the control unit 13 directly proceeds to step S28.

What is claimed is:

1. An engine idle control system for a vehicle which causes the engine speed to converge on a target idling speed by a feedback control when the engine idles characterized in that said control system is provided with an engine speed sensor and a means for detecting whether the engine is revolving by itself or is being driven by the vehicle, and controls the engine speed by a proportional feedback control on the basis of the difference between an actual engine speed and the target idling speed when the engine is being driven by the vehicle while controlling the engine speed by a control at least a part of which is an integral feedback control when the engine is revolving by itself.

2. An engine idle control system as defined in claim 1 in which said vehicle is provided with an automatic transmission having a turbine and said means determines whether the engine is revolving by itself or is being driven by the vehicle on the basis of the difference between the engine speed and the turbine speed.

3. An engine idle control system as defined in claim 1 in which said vehicle is provided with a manual transmission and said means determines that the engine is revolving by itself when the transmission is in neutral.

4. An engine idle control system as defined in claim 1 in which when the engine goes to revolve by itself from a state where it is driven by the vehicle the proportional feedback control is shifted to said control at least a part of which is an integral feedback control after a proportional feedback amount becomes zero.

* * * * *